United States Patent [19]

Jung et al.

[11] 4,058,640

[45] Nov. 15, 1977

[54] ELECTRICAL INSULATION OF METALLIC CONDUCTORS

[75] Inventors: Hans Jung, Ludwigshafen; Jenoe Kovacs, Bobenheim-Roxheim; Wilhelm Düssel, Ludwigshafen; Helmut Lehmann, Reinbek, all of Germany

[73] Assignee: BASF Aktiengesellschaft, Ludwigshafen, Germany

[21] Appl. No.: 684,308

[22] Filed: May 7, 1976

[30] Foreign Application Priority Data

May 24, 1975 Germany ..... 2523099

[51] Int. Cl.[2] ..... B05D 7/20; B05D 5/12; B05D 3/02; B05D 1/42

[52] U.S. Cl. ..... 427/118; 427/120

[58] Field of Search ..... 427/118, 120

[56] References Cited

U.S. PATENT DOCUMENTS

| | | | |
|---|---|---|---|
| 3,148,169 | 9/1964 | Martens et al. | 427/120 X |
| 3,171,866 | 3/1965 | Meyer et al. | 427/120 X |

*Primary Examiner*—James R. Hoffman

*Attorney, Agent, or Firm*—Keil, Thompson & Shurtleff

[57] ABSTRACT

A process for the electrical insulation of metallic conductors by coating wires with aqueous dispersions of coating materials, comprising the following steps which are carried out in a single cycle: introducing the starting dispersion into a storage zone A; continuously withdrawing part of the dispersion from the storage zone and feeding said part to a dispersing zone, where it is homogenized and comminuted; if necessary, cooling the dispersion to below 40° C in a cooling zone; feeding the dispersion to a fractionating zone D, where it is separated into a coarse fraction and a fine fraction; and finally, passing the fine fraction through coating zones E, through which wires are drawn so as to receive a coating.

1 Claim, 4 Drawing Figures

ELECTRICAL INSULATION OF METALLIC CONDUCTORS

The present invention relates to a process for coating wires with aqueous dispersions of coating materials.

Metallic conductors are usually coated with synthetic resins which are applied in the form of solutions in organic solvents. On subsequent baking of the applied coating, the solvent evaporates and contributes to pollution of the environment.

For this reason, attempts have been made to coat wires with aqueous dispersions. German Published Application No. 2,351,078 describes wire enamels based on aqueous polyester-imide dispersions wherein the preferred particle diameter is from 0.05 to 1.5$\mu$. In the said Patent Application, the dispersion is prepared, and then applied to copper wires, in two separate steps. German Printed Application No. 1,285,081 describes wire enamels comprising aqueous polyester dispersions. Here again, the preparation of the dispersion and coating are carried out in two separate steps; to achieve a uniform coating, continuous filtration of the dispersion is recommended.

It is an object of the present invention to provide a simple coating process in which preparation of the dispersion and coating are carried out in a single cycle and in which the dispersion can be recycled virtually without losses. It is a further object of the invention to provide wire enamels which can be baked in conventional equipment, the resulting coatings having, as far as their properties are concerned, no significant disadvantages compared with coatings prepared from conventional solution-based enamels.

We have found that these objects are achieved by a process for the electrical insulation of matallic conductors by coating wires with aqueous dispersions, of from 10 to 60 percent strength by weight, of polymeric organic coating materials, which process comprises the following steps which are carried out in a single cycle:

A starting dispersion of the coating material is introduced into a storage zone A;

part of the dispersion is continuously withdrawn from the storage zone A and fed to a dispersing zone B, where it is homogenized and brought to a mean particle size of less then 10$\mu$u, whilst keeping the temperature of the dispersion below 60° C;

if necessary, the dispersion is cooled to below 40° C in a cooling zone C;

the dispersion is then fed continuously to a fractionating zone D in which it is separated, according to particle size, into a. a fine fraction having a mean particle size of from 0.2 to 2$\mu$u and containing virtually no particles larger than 6$\mu$u, and b. a coarse fraction which contains larger particles and is recycled to the storage zone A; and finally, the fine fraction, at below 40° C, is passed continuously through one or more coating zones E and then recycled to the storage zone A, and at the same time one or more wires of diameter greater than 0.05 mm are drawn through coating zone(s) E and provided with a coating which is then baked.

The invention can best be understood by reference to the attached drawing in which.

Figure 1:
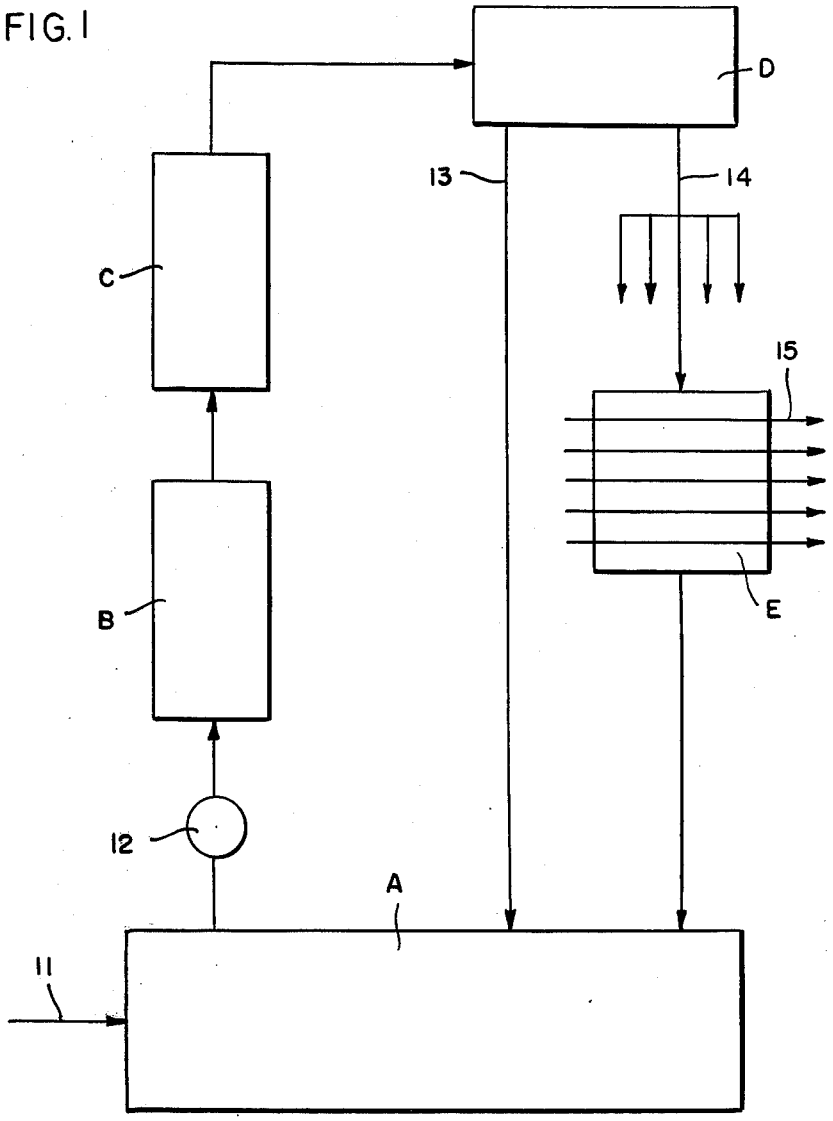
FIG. 1 is a schematic representation illustrating a preferred embodiment of a dispersing and coating system of the present invention.

As is shown in FIG. 1, the starting dispersion is introduced via line 11 into the storage zone A from where it is withdrawn, advantageously by a pump 12, and fed to the dispersing zone B. The homogenized and comminuted dispersion is cooled in the cooling zone C and is then fed to the fractionating zone D, where it is separated into a coarse fraction and a fine fraction. The coarse fraction is recycled directly to the storage zone A via line 13; the fine fraction is also returned to the storage zone, via line 14, but through the coating zone E. Wires 15 are drawn through the coating zone E, and coated there.

Resins which may be used for wire enameling according to the invention are any polymeric organic coating materials suitable for this purpose. The following are particularly suitable:

Polyesters of aromatic dicarboxylic acids and polyhydric alcohols, which are preferably crosslinked by co-condensation of tris-hydroxyethyl-isocyanurate; polyamide-imides, manufactured by reacting trimellitic anhydride or its derivatives with aromatic diamines or diisocyanates, or by reacting diimide-dicarboxylic acids with diisocyanates, eg. in accordance with German Printed Application Nos. 1,256,418, 1,765,738 or 1,720,909; polyimides based on aromatic tetracarboxylic acid dianhydrides or their derivatives and aromatic diamines; polyurethanes of a mixture of a hydroxyl-containing polyester and a blocked polyisocyanate; polyamides of dicarboxylic acids and diamines; polyacrylates based on copolymers of esters of acrylic acid or methacrylic acid.

In principle, it is possible to use any polymeric organic resin which can be converted into a dispersion and which melts at an elevated temperature and gives a coherent coating when applied to a wire. Heat-resistant polymers which, after baking on the wire, have a maximum use temperature, measured according to DIN 53,446, of above 100° C, preferably above 150° C, are preferred.

Polyester-imides which are polycondensation products of aromatic polycarboxylic acids, polyhydric alcohols and polyfunctional amines are particularly preferred. Those in general contain from 0.5 to 7, preferably from 1 to 5, percent by weight of imide nitrogen in the form of 5-membered imide rings which are fused to aromatic nuclei. They may be manufactured from the following starting materials:

10 equivalents of aromatic tricarboxylic or tetracarboxylic acids, their anhydrides or esters, eg. trimellitic acid, pyromellitic acid or their anhydrides, if appropriate together with aromatic dicarboxylic acids or their esters, eg. terephthalic acid, isophthalic acid or naphthalenedicarboxylic acid, and their lower alkyl ester, from 5 to 20 equivalents of lower aliphatic diols, if appropriate together with trihydric or tetrahydric alcohols, eg. ethylene glycol, propylene glycol or butanediol together with glycerol, trimethylolpropane or trihydroxyethyl-isocyanurate, and from 1 to 5 equivalents of di-primary or tri-primary amines, eg. ethylenediamine, hexamethylenediamine, benzidine, diaminodiphenylmethane, diaminobenzophenone, diaminodiphenyl ether or diaminondiphenyl sulfone, phenylenediamine,toluylenediamines, xylylenediamines or melamine.

It is possible either to condense the starting materials together, preferably in the presence of solvents, or to employ precondensates, eg. diimide-dicarboxylic acids obtained from 2 moles of trimellitic anhydride and 1 mole of a di-primary aromatic amine. The manufacture of polyester-imides is described, eg., in German Printed Applications Nos. 1,445,263, 1,495,100, 1,495,152 and 1,645,435 and in German Published Application No. 2,412,471.

Aqueous resin dispersions containing from 10 to 60 percent by weight of the resin are employed in the process according to the invention. In addition to the resins, the dispersion may contain the following constituents:

from 1 to 5 percent by weight of suspension stabilizers, eg. polyvinylpyrrolidone, copolymers of vinyl propionate and vinyl-pyrrolidone, polyacrylic acid or partially saponified copolymers of acrylic esters and acrylonitrile, from 0.1 to 2 percent by weight of surface-active compounds, eg, polyvinyl alcohols, cellulose ethers or gelatine, from 1 to 10 percent by weight of flow improvers, eg. butanediol, diethylene glycol, glycol monoethers, dimethylformamide, dimethylacetamide or N-methylpyrrolidone, from 0.1 to 2 percent by weight of thickeners, eg. high molecular weight polyvinylpyrrolidone or vinylpyrrolidone copolymers, from 0.05 to 3 percent by weight of anit-thixotropic agents, eg. ethanolamine or triethanolamine, from 0.1 to 3 percent by weight of neutralizing agents, eg. hexamethylenetetramine or other amines, from 0.5 to 5 percent by weight of baking catalysts, eg. oxotitanates, triethanolamine titanate, titanium lactate or titanium oxalate, such catalysts being particularly important in the case of polyester-imide dispersions, and where special effects are desired, pigments, fillers or dyes.

The starting dispersion of the organic resin can be manufactured either directly by polymerization or polycondensation in aqueous dispersion, or by freeze-drying, in accordance with the method of German Published Application No. 2,460,472, a solution of the resin in an organic solvent, and dispersing the resulting powder in water. Finally, it is also possible to mill the solid resin, in the dry state, in conventional mechanical mills, eg. impact disc mills or pin mills, and then to disperse it in water.

If desired, the dispersion can be subjected to a preliminary milling treatment by comminuting the particles, in conventional ball mills, to a mean particles size of less than 10μu and preferably less than 5μu. Such wet milling is described in German Published Application No. 2,351,077.

However, it is preferred to start from a coarse dispersion having a mean particle size of from 10 to 50μu. For the purposes of the present invention, mean particle size is to be understood as the $d_{50}$ value of the number-average; the particle size was measured by means of a sedimentation balance.

It is advantageous if, during the continuous dispersing and coating process in which the dispersion is recycled and only small proportions thereof are consumed, the starting dispersion is fed intermittently to the storage zone by making additions at substantial intervals of time. The dispersion contained in the storage zone A sould if possible be agitated so that there are not stagnating zones in which excessive agglomeration of the resin particles occurs. This is advantageously achieved by providing the storage vessel with a stirrer.

Part of the dispersion is continuously withdrawn from the storage zone A, advantageously by means of a pump, and fed to a dispersing zone B. Any type of pump suitable for thixotropic fluids may be used, in particle a gear pump, but also a centrifugal pump or hose pump.

Figure 2:
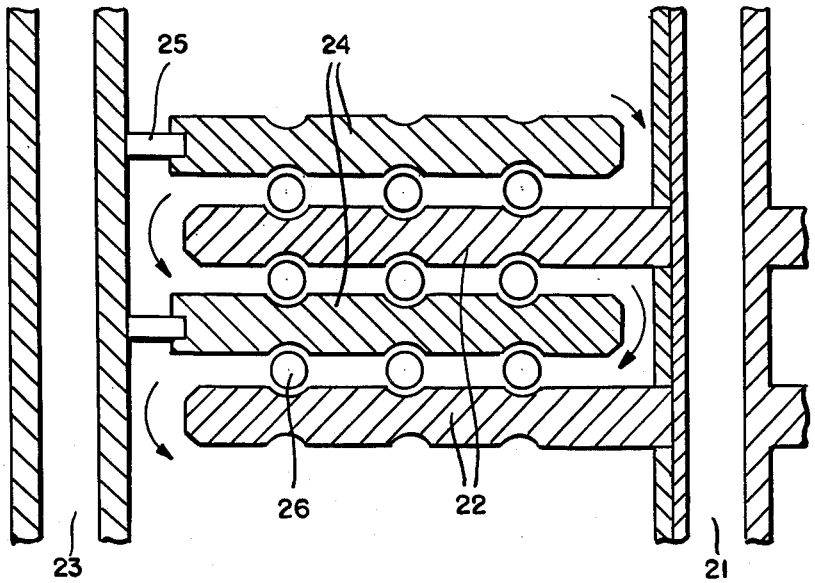
FIG. 2 is an enlarged sectional view of an embodiment of the dispersing zone B shown in FIG. 1.

The dispersion is fed to the dispersing zone B, where it is homogenized and brought to a mean particle size of less than 10μu, preferably less than 5μu and especially less than 3μu. If the starting dispersion which has been introduced into the storage zone A is a coarse dispersion, the dispersing zone must be in the form of a mill. In this case it is essential that milling should take place with little abrasion, ie. during grinding particles, eg. glass splinters or metal powder, should not be abraded from the grinding medium. A particularly suitable milling apparatus comprises several discs provided with grooves in which balls move, and is shown in FIG. 2.

Discs 22 are attached to a shaft 21, which can be cooled, by means of dovetails (not shown), so that the discs rotate with the shaft but are movable in the axial direction. Discs 24 are joined to the housing 23, which can be cooled, by means of rubber rings 25. The discs 24 cannot rotate but also have some freedom of movement in the axial direction. The discs are provided with concentric grooves in which several balls 26 run. The maximum depth of these grooves is preferably greater than one-third of the diameter of the balls. The dispersion passes between the discs in the direction indicated by the arrows, and its particles are comminuted by the balls. The material of construction of the discs should have a lower modulus of elasticity than that of the balls. Particularly little abrasion on milling occurs if the discs are made of polyamide and the balls of steel or, better still, of glass. Other suitable equipment may be employed instead of this preferred milling and dispersing apparatus.

If a starting dispersion which has already been premilled is introduced into the storage zone A, subsequent milling need not be as intensive as in the above case. In some cases, dispersion can also be achieved by using an oversize pump for taking the dispersion from the storage zone, eg. by using a powerful gear pump. Some milling must, however, always be carried out in the dispersing zone since the formation of agglomerates in the storage zone A, in the fractionating zone D and in the coating zone E can never be entirely avoided. These agglomerated particles are comminuted to the required small particle size in the dispersing zone B. If the circulation system is operated without a dispersing zone, the enameled wires are no longer up to specification after an on-stream period of only 8 hours, ie. they exhibit, eg., an irregular surface and insufficient dielectric strength according to DIN 53,481. Advantageously, the dispersing zone is cooled, so that the temperature of the dispersion in this zone is kept below 60° and preferably below 40° C. If the temperature of the dispersion rises to too high a level, the dispersion has a greater tendency to agglomerate; in the extreme case, sticky lumps form which clog the coating apparatus.

Since — as will be explained in more detail — the temperature in the coating zone must be even lower, it is necessary in most cases, particularly if intensive milling is carried out, to cool the dispersion further. This is advantageously done in a cooling zone C, where the dispersion is cooled to below 40° and preferably below 30° C.

The dispersion is then fed to a fractionating zone D, in which a separation according to particle size is carried out. The following are obtained:

a. A fine fraction having a mean particle size of from 0.2 to 2μu, preferably from 0.5 to 1.5μu, and containing virtually no particles larger than 6μu, and preferably no particles larger than 4μu, ie. the fine fraction should contain less than 1%, and preferably less than 0.1%, of such coarse particles.

b. In addition, a coarse fraction which contains larger particles, ie. particles having a mean size greater than that of the fine fraction. This coarse fraction is directly recycled to the storage zone A, whilst the fine fraction first passes through the coating zones.

Figure 3:
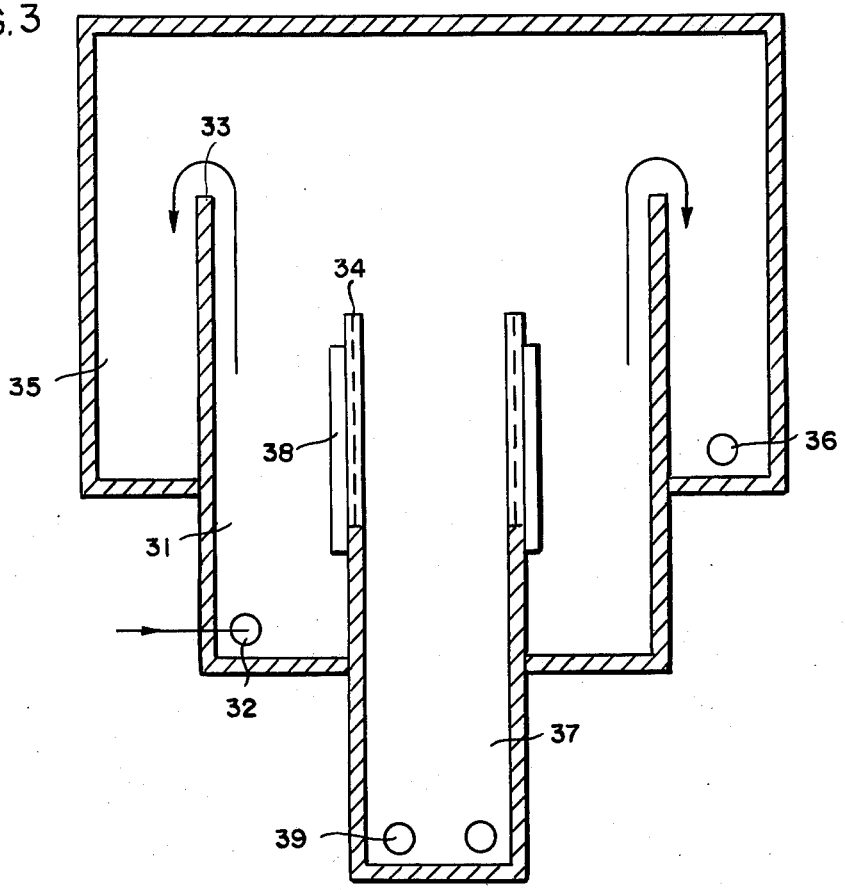
FIG. 3 is an enlarged sectional view of an embodiment of the fractionating zone D shown in FIG. 1.

A particularly advantageous embodiment of the fractionating zone is shown in FIG. 3:

The dispersion is injected through an orifice 32 tangentially into an inner cylinder 31, where it forms a vortex, as a result of which the coarse particles (coarse fraction 33) accumulate against the outer wall of the cylinder 31 and flow, over an overflow edge, into the annular space 35 and from there leave through an orifice 36. The fine fraction 34 accumulates in the center and flows through a distributor tube 37, which is slotted and covered with filter cloth 38, and then through orifices 39 into the coating zones. If a dispersion having a mean particle size of 1μu and a maximum particle size of 8μu is allowed to run through a fractionating apparatus of this type, the dispersion entering at a velocity of 200 m/minute, two fractions which have the particle size spectrum shown below are obtained if a filter cloth of 40μu aperture size is employed:

a. Coarse dispersion having a mean size of 1.3μu and a maximum size of 8μu, and b. Fine dispersion having a mean size of 0.9μu and a maximum size of 4μu. Finally, the fine fraction flows to one or more coating zones E. Since the coating zones are, in general, open systems, the temperature of the dispersion should advantageously be below room temperature to keep water losses due to evaporation to a minimum. For this reason it may be necessary first to cool the dispersion, in a separate cooling zone C, to a temperature below 40° and preferably below 30° C. The fine dispersion flows through the coating zone and is subsequently recycled to the storage zone A. In principle, the invention can be carried out using a single coating zone; in practice, a plurality of coating apparatuses, advantageously from about 3 to 30, are arranged in parallel.

Figure 4:
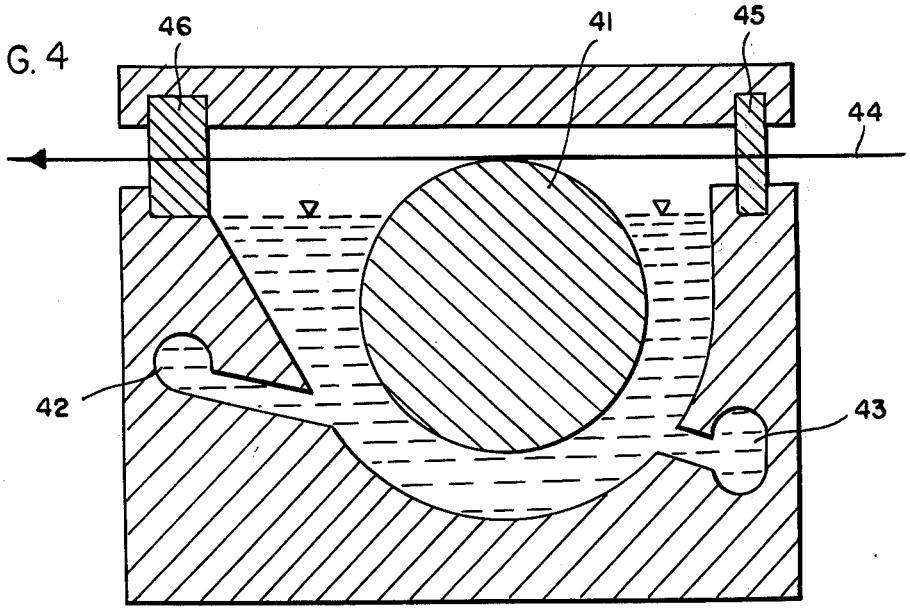
FIG. 4 is an enlarged sectional view of an embodiment of the coating apparatus E shown in FIG. 1.

FIG. 4 shows a section through an advantageous embodiment of a coating apparatus:

The dispersion enters the coating vessel through an orifice 42, tangentially to the applicator roll 41, and leaves the vessel again through an outlet 43 connected to a constant-level device, not shown in the drawing. The wire 44 rests on the applicator roll, the roll being rotated by the moving wire. The wire is drawn through two pairs of felt wiper pads 45 and 46. The applicator roll is advantageously made of plastics material of specific gravity equal to or less than that of the dispersion; as a result, the roll floats on the dispersion. The constant-level device can therefore be used to adjust the pressure of the roll against the wire and hence also to regulate the amount of enamel picked up by the wire. Advantageously, the roll is provided with one fine thread or two fine threads (one left-hand, the other right-hand) cut on its surface, so that the wire, on passing through the pair of felt wiper pads 46, executes a horizontal and vertical movement, as a result of which the felt pads are self-cleaning. In practice a plurality, preferably from four to 20, wires are passed over one applicator roll in each coating unit. The wires in general have a diameter greater than 0.05 mm and preferably from 0.1 to 2 mm. No only round, but also flat, wires can be coated. After coating, the wires pass through an oven in which the enamel is baked, in general at from 200° to 600° C. In the course of this baking operation, crosslinking of the polymeric organic coating material generally occurs, and water evaporates. Advantageously, the wires are drawn more than once through the coating apparatus and the oven; the number of passes may be up to 20. In general, from 1 to 10μu of coating is applied per pass.

To keep agglomeration to a minimum, those parts of the circulation system of the invention which which the dispersion comes into contact should be made of electrically non-conducting material, ie. the lines through which the dispersion passes, and the coating apparatuses, should advantageously be made of plastics material.

A small amount of dispersion is consumed in the coating operation. The ratio of the volume $V_1$ of dispersion applied in a coating zone to the volume $V_2$ of the fine despersion introduced into this coating zones, each volume being per unit time, should preferably be less than 1:30 and in particular less than 1:50. With $n$ coating units connected in parallel, the ratio $n \times V_2$ to the volume $V_3$ of dispersion taken from the storage zone A per unit time should preferably be less than 1:10 and in particular less than 1:20. A total of preferably less than 1/500 of the dispersion $V_3$ which is being circulated should be consumed in the coating operation.

Experiments have shown that the continuous dispersing and coating process of the invention can be operated without trouble for several months and that the coated wires are of constant high quality.

We claim:

1. A process for the electrical insulation of metallic conductors by coating wires with aqueous dispersions, of from 10 to 60 percent by weight, of polymeric organic coating materials, which process comprises the following steps which are carried out in a single cycle:

introducing a starting dispersion of the coating material into a storage zone;

continuously withdrawing a part of the dispersion from the storage zone and feeding said part to a dispersing zone where it is homogenized and brought to a mean particle size of less than 10μu, while keeping the temperature of the dispersion below 60° C;

optionally cooling the dispersion to below 40° C in a cooling zone;

feeding the dispersion continuously to a fractionating zone in which it is separated, according to particle size, into a fine fraction having a mean particle size of from 0.2 to 2μu and containing practically no particles larger than 6μu, and (b) a coarse fraction which contains larger particles and is recycled to the storage zone; and finally, passing the fine fraction, at below 40° C, continuously through one or more coating zones and then recycled to the storage zone, and at the same time one or more wires of diameter greater than 0.05 mm are drawn through coating zones(s) and provided with a coating which is then baked where one or more wires having a diameter greater than 0.05 mm are drawn through said coating zone(s) and coated therein, which coating is then baked, the excess of the film fraction of the aqueous dispersion being recycled to the storage zone.

* * * * *